US009876286B2

(12) United States Patent
Urano

(10) Patent No.: US 9,876,286 B2
(45) Date of Patent: Jan. 23, 2018

(54) CONNECTOR

(71) Applicant: Japan Aviation Electronics Industry, Limited, Tokyo (JP)

(72) Inventor: Tetsu Urano, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 7 days.

(21) Appl. No.: 15/140,910

(22) Filed: Apr. 28, 2016

(65) Prior Publication Data

US 2017/0005421 A1 Jan. 5, 2017

(30) Foreign Application Priority Data

Jun. 30, 2015 (JP) ..... 2015-131328

(51) Int. Cl.

| | |
|---|---|
| ***H01R 13/11*** | (2006.01) |
| ***H01R 4/48*** | (2006.01) |
| ***H01R 13/187*** | (2006.01) |
| *H01R 4/26* | (2006.01) |
| *H01R 12/51* | (2011.01) |

(52) U.S. Cl.

CPC ..... *H01R 4/4836* (2013.01); *H01R 4/4845* (2013.01); *H01R 13/187* (2013.01); *H01R 4/26* (2013.01); *H01R 12/515* (2013.01)

(58) Field of Classification Search

CPC ... H01R 13/113; H01R 13/111; H01R 13/115; H01R 9/091; H01R 13/112; H01R 4/4809

USPC ..... 439/852, 851, 850, 853, 856, 857, 862, 439/816, 849, 861

See application file for complete search history.

(56) References Cited

U.S. PATENT DOCUMENTS

| | | | | |
|---|---|---|---|---|
| 7,513,793 | B2 | 4/2009 | Horst et al. | |
| 7,656,176 | B2 * | 2/2010 | Yoshioka | G01R 1/0735 324/756.07 |
| 2002/0155750 | A1 | 10/2002 | Beege et al. | |
| 2011/0130052 | A1 * | 6/2011 | Chen | H01R 13/111 439/852 |
| 2011/0217882 | A1 | 9/2011 | Gassauer | |

(Continued)

FOREIGN PATENT DOCUMENTS

| | | | |
|---|---|---|---|
| EP | 2 065 980 | A2 | 6/2009 |
| JP | 2004-014145 | A | 1/2004 |
| JP | 2007-087621 | A | 4/2007 |

(Continued)

OTHER PUBLICATIONS

Extended European Search Report in EP 16169402.1-1801, dated Dec. 5, 2016.

*Primary Examiner* — Phuong Chi T Nguyen
(74) *Attorney, Agent, or Firm* — Collard & Roe, P.C.

(57) ABSTRACT

A connector is connectable with a conductive core of a cable which is inserted from a front of the connector along a front-rear direction. The connector comprises a shell and a spring member. The shell is made of a metal. The shell has an operation portion and a contact portion. The spring member is made of another metal which is harder than the metal of the shell. The spring member has an operated portion and a press portion. When the operation portion moves the operated portion, the press portion is moved away from the contact portion. The press portion presses the conductive core against the contact portion under a connection state where the conductive core is connected with the connector.

15 Claims, 8 Drawing Sheets

(56) References Cited

U.S. PATENT DOCUMENTS

2015/0087193 A1 3/2015 Takane

FOREIGN PATENT DOCUMENTS

JP 5067977 B2 11/2012
JP 5604575 B1 10/2014

* cited by examiner

CONNECTOR

CROSS REFERENCE TO RELATED APPLICATIONS

An applicant claims priority under 35 U.S.C. §119 of Japanese Patent Application No. JP2015-131328 filed Jun. 30, 2015.

BACKGROUND OF THE INVENTION

This invention relates to a connector connectable to a conducive core of a cable.

For example, JP-A 2004-014145 (Patent Document 1) discloses a connector of this type.

Referring to FIG. 15, Patent Document 1 discloses a quick-connection terminal (connector) 900 connectable to a lead wire (conductive core) 990. Referring to FIGS. 15 and 16, the connector 900 comprises a housing 910 made of a conductor, two S-shaped springs 920 and a release button 930. Each of the S-shaped springs 920 has a free end 922. When the release button 930 is pressed in a negative Y-direction, each of the S-shaped springs 920 is resiliently deformed so that its free end 922 is moved outward in an X-direction. In this state, the lead wire 990 is inserted into the connector 900. After that, when the release button 930 is released from being pressed, the free end 922 is moved inward in the X-direction so that the lead wire 990 is held by the connector 900 to be connected therewith.

As understood from FIG. 16, the S-shaped spring 920 having an S-like shape is easily resiliently deformable as a whole. Accordingly, the lead wire 990 might be released from the connector 900 when the lead wire 990 held by the connector 900 receives a force in a positive Y-direction. In other words, the connection state of the connector 900 with the lead wire 990 is easily releasable.

SUMMARY OF THE INVENTION

It is therefore an object of the present invention to provide a connector which is connectable to a conductive core of a cable and which is able to securely maintain a connection state of the connector with the conductive core.

One aspect of the present invention provides a connector connectable with a conductive core of a cable which is inserted from a front of the connector along a front-rear direction. The connector comprises a shell and a spring member. The shell is made of a metal. The shell has an operation portion and a contact portion. The spring member is made of another metal which is harder than the metal of the shell. The spring member has an operated portion and a press portion. When the operation portion moves the operated portion, the press portion is moved away from the contact portion. The press portion presses the conductive core against the contact portion under a connection state where the conductive core is connected with the connector.

According to the present invention, the press portion of the spring member whose metal is harder than the metal of the shell presses the conductive core against the contact portion of the shell under the connection state of the connector with the conductive core. The thus-configured press portion easily bites into the conductive core when the conductive core is about to be pulled out from the connector under the connection state. Accordingly, the conductive core can be prevented from being pulled out from the connector so that the connection state is securely maintained. Especially, in a case where the spring member is provided with a slope portion which intersects with the front-rear direction, or an insertion direction of the conductive core, at an angle equal to or greater than 45° while an rear edge of the slope portion functions as the press portion, the press portion can more surely bite into the conductive core when the conductive core is about to be pulled out from the connector under the connection state. Thus, the connection state can be more securely maintained.

Figure 1:
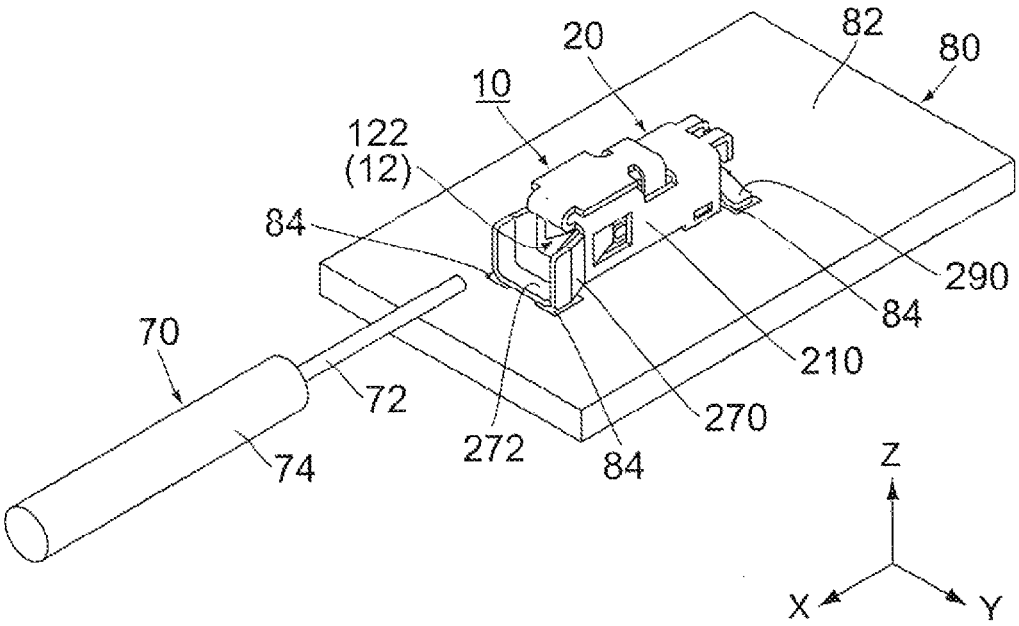
FIG. 1 is a perspective view showing a connector according to an embodiment of the present invention together with a cable and a circuit board, wherein the connector is mounted on the circuit board, but a conductive core of the cable is not inserted into the connector.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector 10 according to an embodiment of the present invention is fixed on an upper surface 82 of a circuit board 80, or an object 80, in an up-down direction when used. In the present embodiment, the up-down direction is a Z-direction. A positive Z-direction is upward, and a negative Z-direction is downward. The upper surface 82 of the circuit board 80 is a positive i-side surface thereof. The upper surface 82 of the circuit board 80 is provided with a plurality of pads 84 each made of a conductor. The connector 10 is fixed by soldering or the like to the pads 84 to be electrically connected therewith when used. However, the present invention is not limited thereto. The present invention is applicable to various connectors each of which is connectable to an object other than the circuit board 80.

Figure 2:
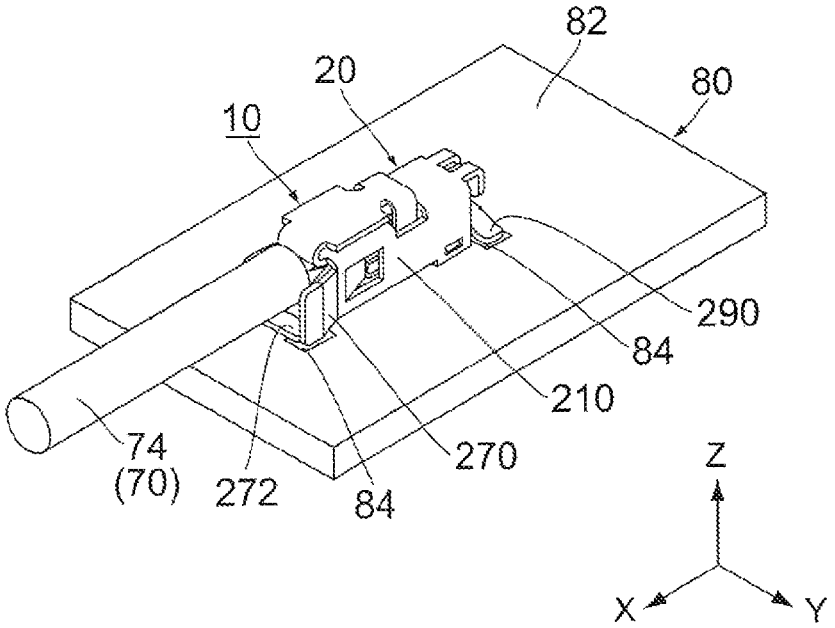
FIG. 2 is a perspective view showing the connector, the cable and the circuit board of FIG. 1, wherein the connector is mounted on the circuit board, and the conductive core of the cable is inserted into the connector.

Referring to FIGS. 1 and 2, the connector 10 fixed to the circuit board 80 is electrically connectable to a conductive core 72 of a cable 70 which is inserted into the connector 10 from a front of the connector 10 along a front-rear direction. In the present embodiment, the front-rear direction is an X-direction. A positive X-direction is forward, and a negative X-direction is rearward. In other words, in the present embodiment, an insertion direction in which the conductive core 72 is inserted into the connector 10 is the negative X-direction. However, the present invention is not limited thereto. For example, the insertion direction of the conductive core 72 may be the negative Z-direction perpendicular to a circuit board.

Figure 13:
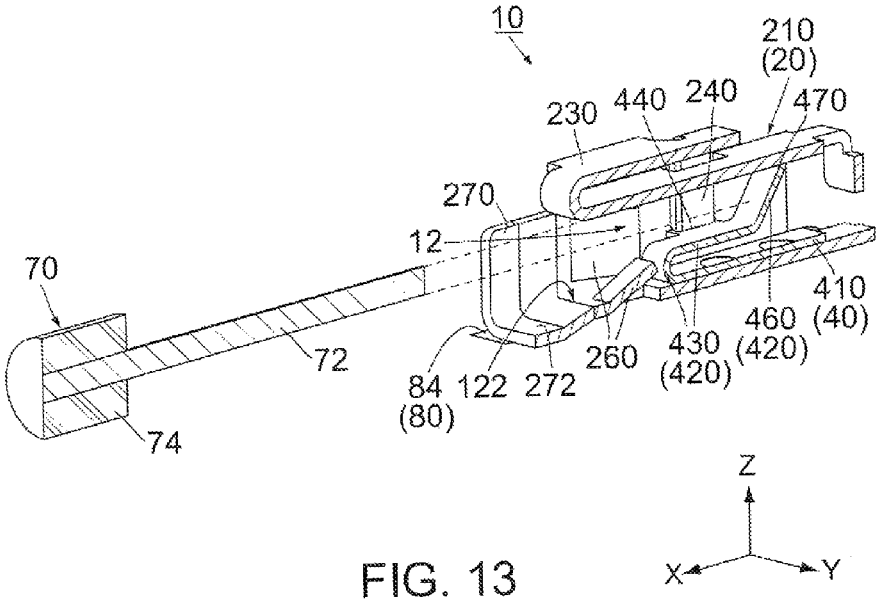
FIG. 13 is a perspective cross section view showing the connector of FIG. 12 together with the cable and a pad of the circuit board, wherein the conductive core of the cable is not inserted into the connector, and an outline of the conductive core upon its insertion into the connector is illustrated by dashed line in the perspective view.

Referring to FIGS. 1 and 13, the cable 70 of the present embodiment has a conductive core 72 made of a conductor and a cover 74 made of an insulator. The cover 74 covers the conductive core 72. The cover 74 is peeled off at an end of the cable 70 to expose the conductive core 72. The conductive core 72 of the present embodiment is a single wire made of a relatively soft metal. However, the present invention is not limited thereto. For example, the conductive core 72 may be a set of twisted wires which is formed by twisting a plurality of conductive thin wires.

Figure 3:
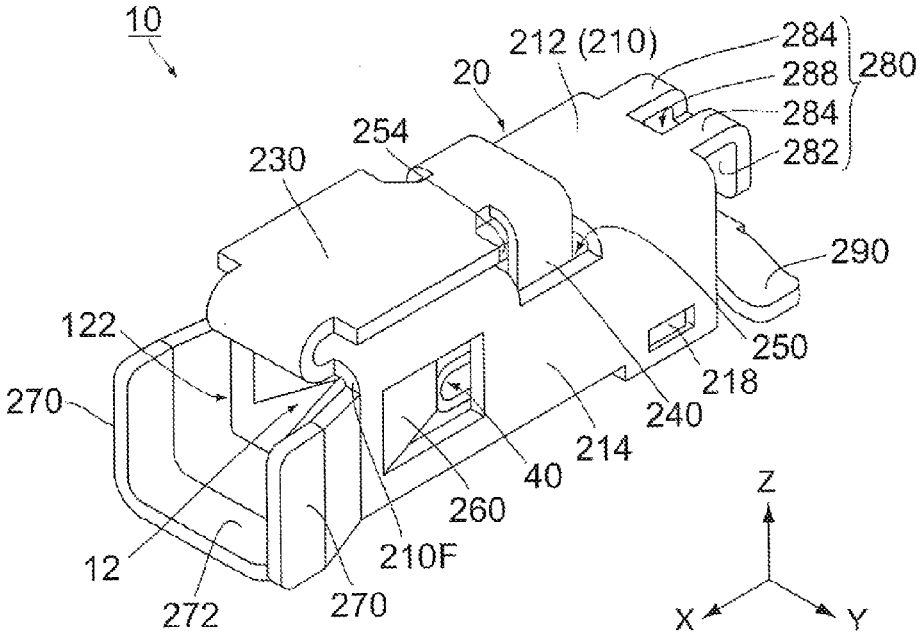
FIG. 3 is a perspective view showing the connector of FIG. 1.
Figure 12:
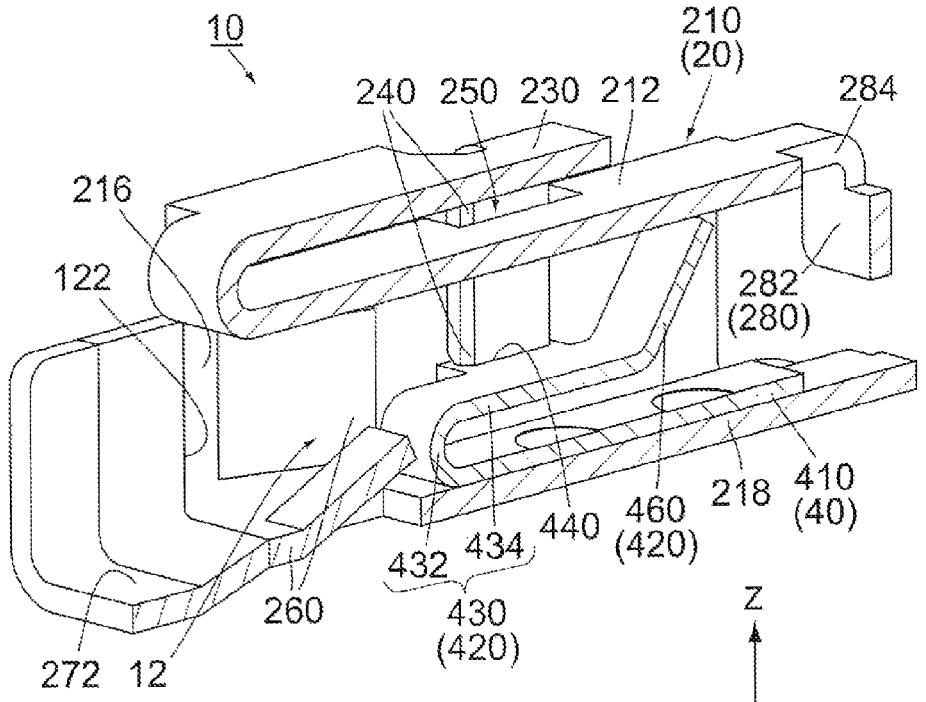
FIG. 12 is a perspective cross-section view of the connector illustrated in FIG. 11.

Referring to FIGS. 3 and 12, the connector 10 of the present embodiment comprises a shell 20 and a spring member 40. The shell 20 is made of a metal, and the spring member 40 is made of another metal which is harder than the metal of the shell 20. In the present embodiment, the shell 20 is formed by bending a single plate made of a metal which is softer than stainless steel and which has conductivity higher than stainless steel. The single plate is not shown in figures and is hereinafter referred to as "first blank". The spring member 40 is formed by bending another single plate made of a hard metal such as stainless steel or the like. The another single plate is not shown in figures and is hereinafter referred to as "second blank". Accordingly, the metal forming the spring member 40 is higher in hardness than the metal forming the shell 20 while the shell 20 is higher in conductivity than the spring member 40. In addition, the metal forming the conductive core 72 is lower in hardness than the metal forming the shell 20.

The connector 10 of the present embodiment is formed only of two members, i.e., the shell 20 and the spring member 40, which are distinct and separated from each other. However, the present invention is not limited thereto. For example, connector 10 according to the present invention may further comprise a member other than, the shell 20 or the spring member 40. In addition, each of the shell 20 and the spring member 40 may be formed by combining a plurality of members.

As shown in FIGS. 3 to 6, the shell 20 of the present embodiment has a main portion 210, a beam portion 230, two operation portions 240, two swing suppressing portions 270, a swing suppressing portion (connecting portion) 272, a stopper 280 and two connecting portions 290.

Referring to FIGS. 3 to 6, the main portion 10 is formed by bending the first blank (not shown). Accordingly, the main portion 210 has a square tubular shape as a who and extends between a front end 210E and a rear end 210R in the X-direction. In detail, the main portion 210 has an upper portion 212, two side portions 214, 216 and a bottom portion 218. Each of the upper portion 212, two side portions 214, 216 and the bottom portion 218 has a plate-like shape. Each of the upper portion 212 and the bottom portion 218 extends in an XY-plane. The upper portion 212 and the bottom portion 218 face each other in the Z-direction. Each of the side portions 214, 216 extends in an XZ-plane. The side portions 214, 216 face each other in a lateral direction. In the present embodiment, the lateral direction is a Y-direction. The side portion 214 is fixed to the bottom portion 218 in the vicinity of a rear, lower end thereof. In the present embodiment, the rear end is a negative X-side end, and the lower end is a negative Z-side end.

Figure 5:
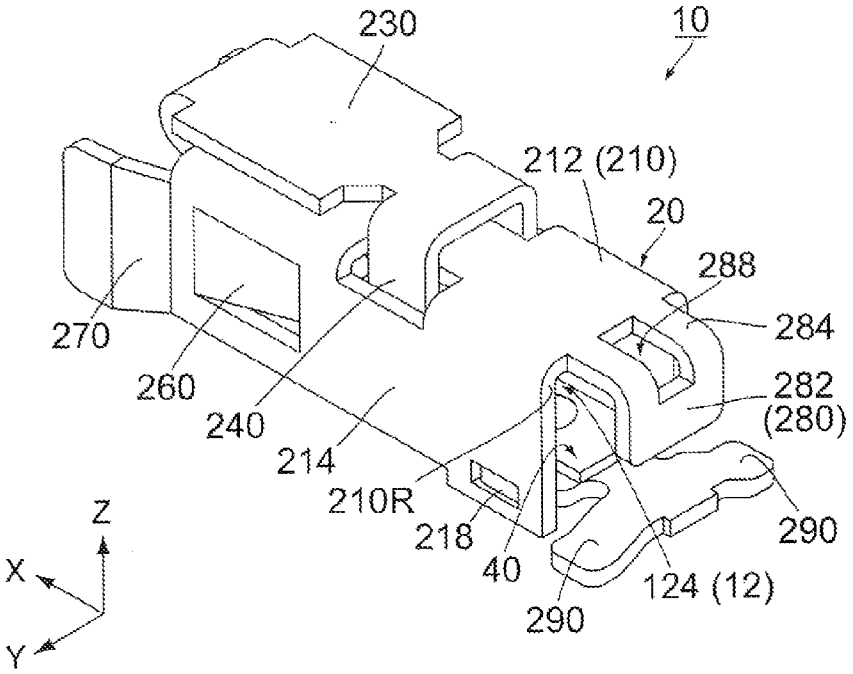
FIG. 5 is yet another perspective view showing the connector of FIG. 3.
Figure 6:
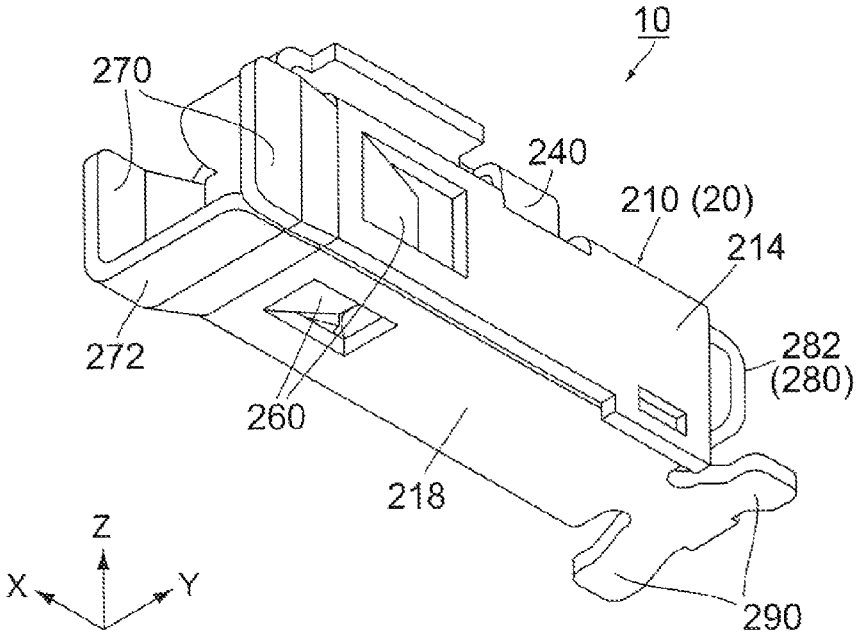
FIG. 6 is still another perspective view snowing the connector of FIG. 3.

Referring to FIGS. 3, 5 and 13, the connector 10 is formed with an insertion space 12 into which the conductive core 72 is inserted. The main portion 210 surrounds the insertion space 12 in a YZ-plane, or in a perpendicular plane. The insertion space 12 has an entrance opening 122 and an exit opening 124. Specifically, the entrance opening 122 opens forward, or in the positive X-direction, and the exit opening 124 opens rearward, or in the negative X-direction. According to the present embodiment, in the X-direction, the entrance opening 122 is positioned at a position same as a position of the front end 210F of the main portion 210, and the exit opening 124 is positioned at a position same as a position of the rear end 210R of the main portion 210. However, the entrance opening 122 may be positioned at a position different from that of the front end 210F. Similarly, the exit opening 124 may be positioned at a position different from that of the rear end 210R.

Figure 14:
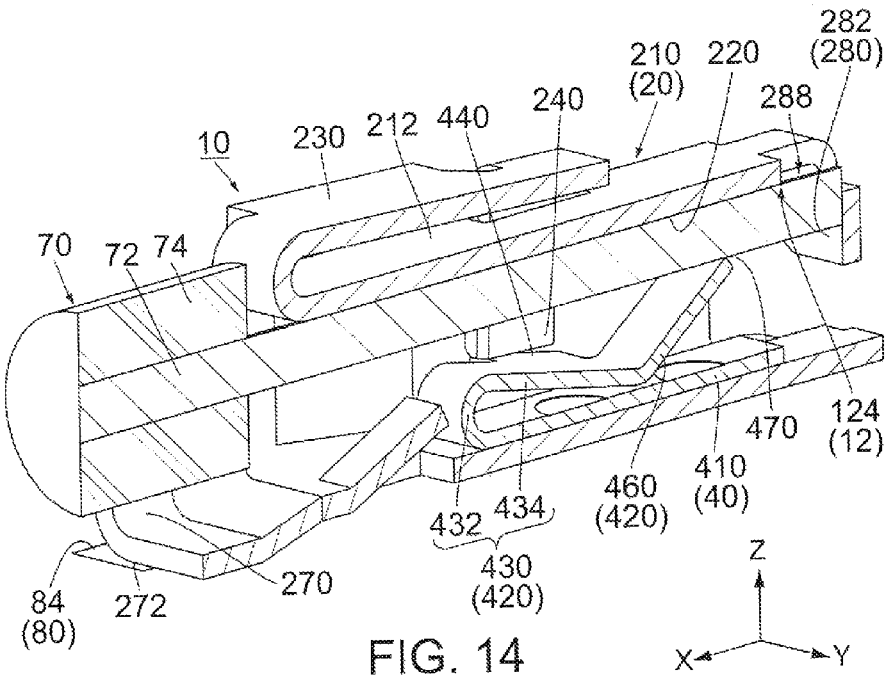
FIG. 14 is a perspective cross section view showing the connector, the cable and the pad of the circuit board of FIG. 13 wherein the conductive core of the cable is inserted in the connector.
Figure 15:
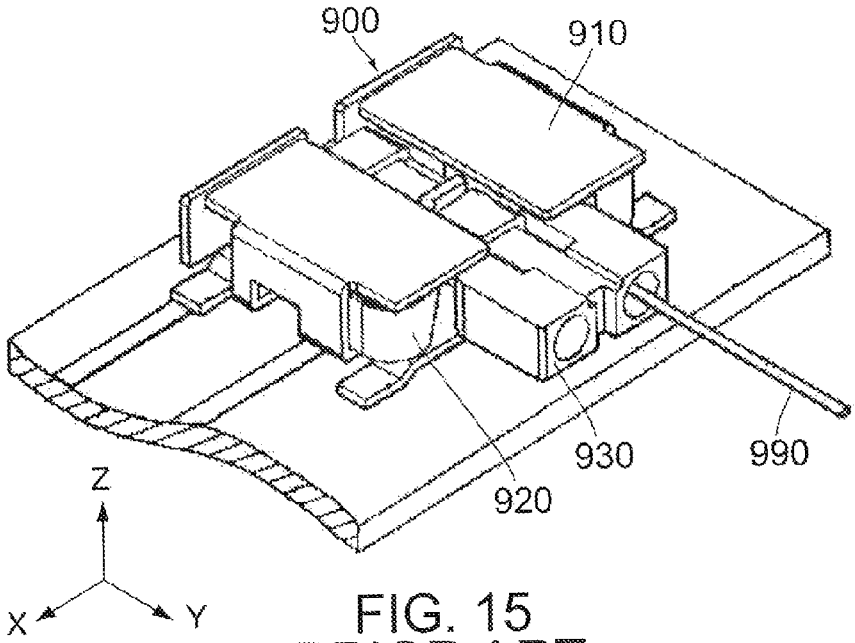
FIG. 15 PRIOR ART
FIG. 15 is a perspective view showing a quick-connection terminal and a lead wire of Patent Document 1.
Figure 16:
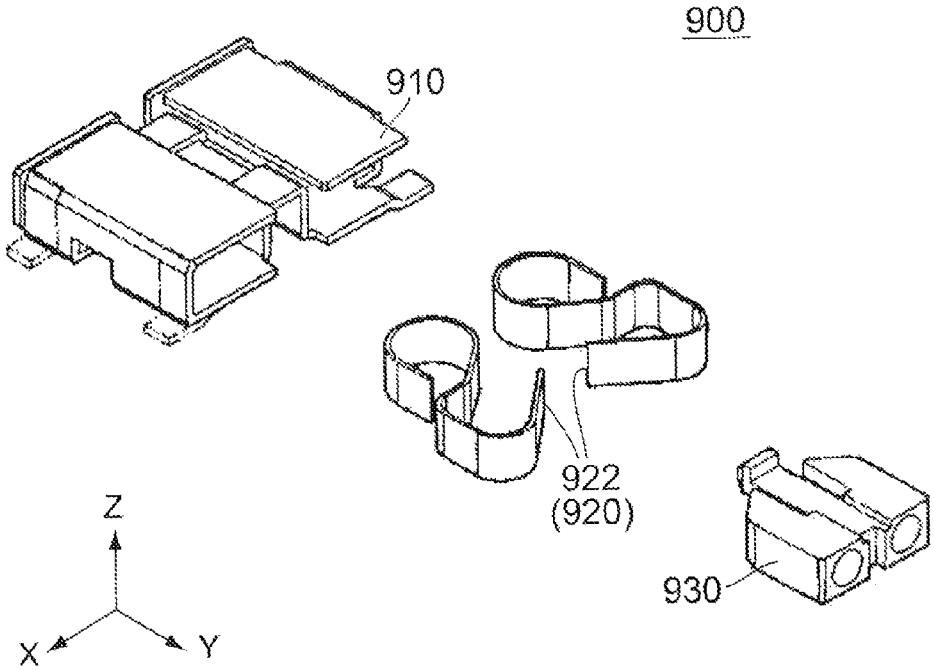
FIG. 16 PRIOR ART
FIG. 16 is an exploded perspective view showing the quick-connection terminal of FIG. 15.

As understood from FIG. 14, the conductive core 72 inserted into the insertion space 12 is brought into contact with a lower surface, or a negative Z-side surface, of the upper portion 212 so that the conductive core 72 is electrically connected with the connector 10. In other words, the shell 20 has a contact portion 220, or the lower surface of the upper portion 212, which is brought into contact with the conductive core 72 under a connection state where the conductive core 72 is connected with the connector 10.

As shown in FIGS. 3, 4, 6, 9 and 12, the main portion 210 has three guide portions 260. Two of the guide portions 260 are provided on the side portions 214, 216, respectively, and a remaining one thereof is provided on the bottom portion 218. Each of the thus-provided guide portions 260 narrows the insertion space 12 in the YZ-plane while extending rearward.

Referring to FIGS. 9 and 11 to 13, when the conductive core 72 is inserted from the entrance opening 122 into the insertion space 12, the guide portion 260 of the bottom portion 218 guides the conductive core 72 toward the contact portion 220. Meanwhile, the guide portions 260 of the side portions 214, 216 guide the conductive core 72 toward a middle part of the contact portion 220 in the Y-direction. In other words, the guide portions 260 according to the present embodiment can guide the conductive core 72 to a predetermined position in the YZ-plane. However, the present invention is not limited thereto. For example, in a case where the conductive core 72 is positioned only by an operation of a user, the main portion 210 may not have the guide portions 260.

Figure 4:
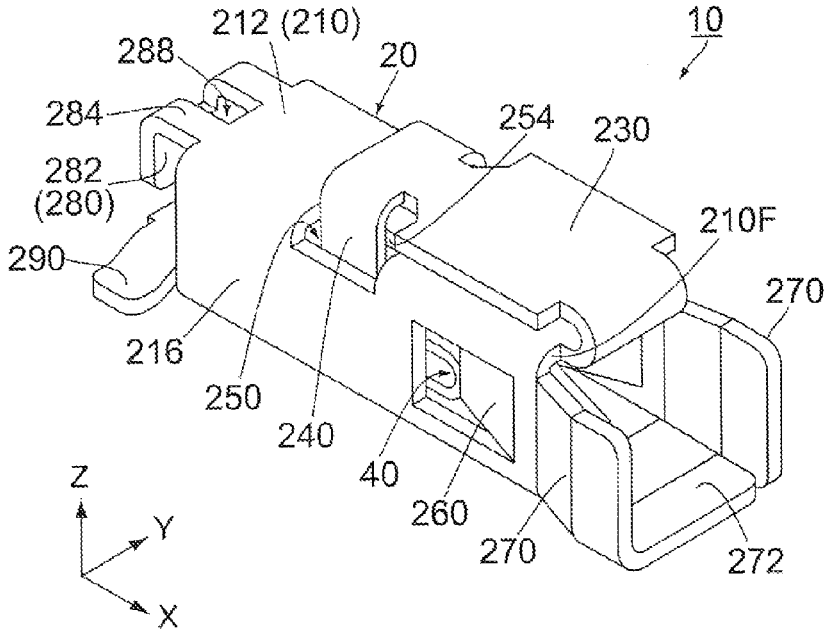
FIG. 4 is another perspective view showing the connector of FIG. 3.

As shown in FIGS. 3, 4 and 12, the upper portion 212 of the main portion 210 is formed with two regulation holes 250. Each of the regulation holes 250 pierces the upper portions 212 in the Z-direction. Each of the regulation holes 250 is positioned at a middle part of the upper portion 212 in the X-direction. In addition, the regulation holes 250 are positioned at opposite sides, respectively, of the upper portion 212 in the Y-direction.

Referring to FIG. 3, the beam portion 230 is supported by the upper portion 212 of the main portion 210 in a cantilevered manner so as to be resiliently deformable. The beam portion 230 is formed by bending a portion of first blank (not shown), which extends forward from the upper portion 212, rearward. The thus-formed beam portion 230 extends parallel to the upper portion 212 from the vicinity of the front end 210F of the main portion 210 to a middle part of the main portion 210 in the X-direction. In addition, the thus-formed beam portion 230 extends in a space which is positioned above the upper portion 212, or beyond the upper portion 212 in the positive Z-direction. The beam portion 230 is formed of a relatively soft metal and has the aforementioned structure which enables itself to be bendable. Accordingly, the beam portion 230 is resiliently deformable even when a slight force is applied thereto.

Figure 7:
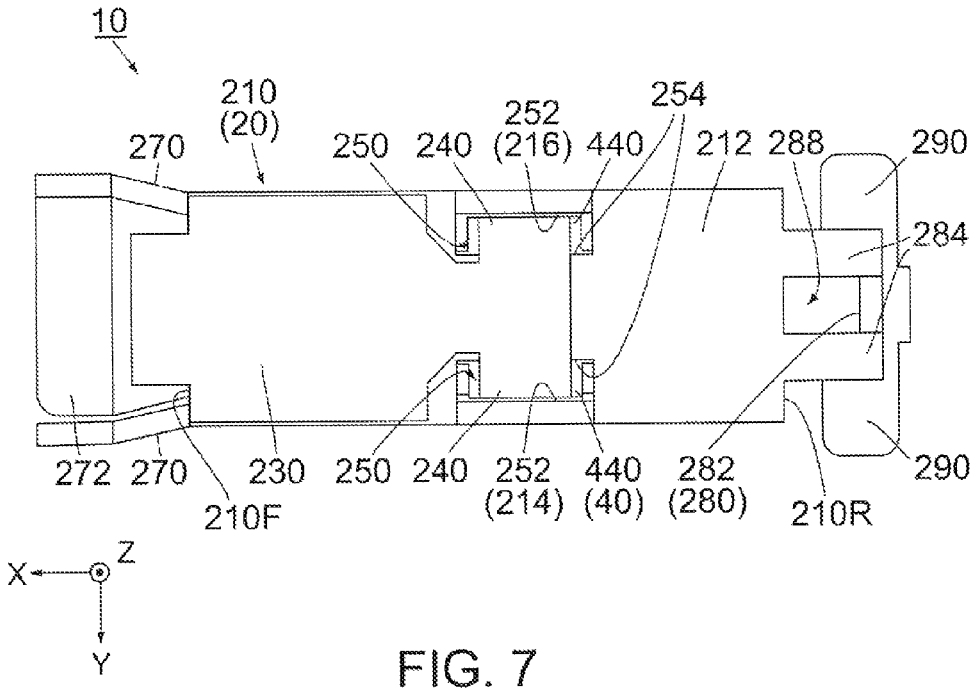
FIG. 7 is a top view showing the connector of FIG. 3.
Figure 8:
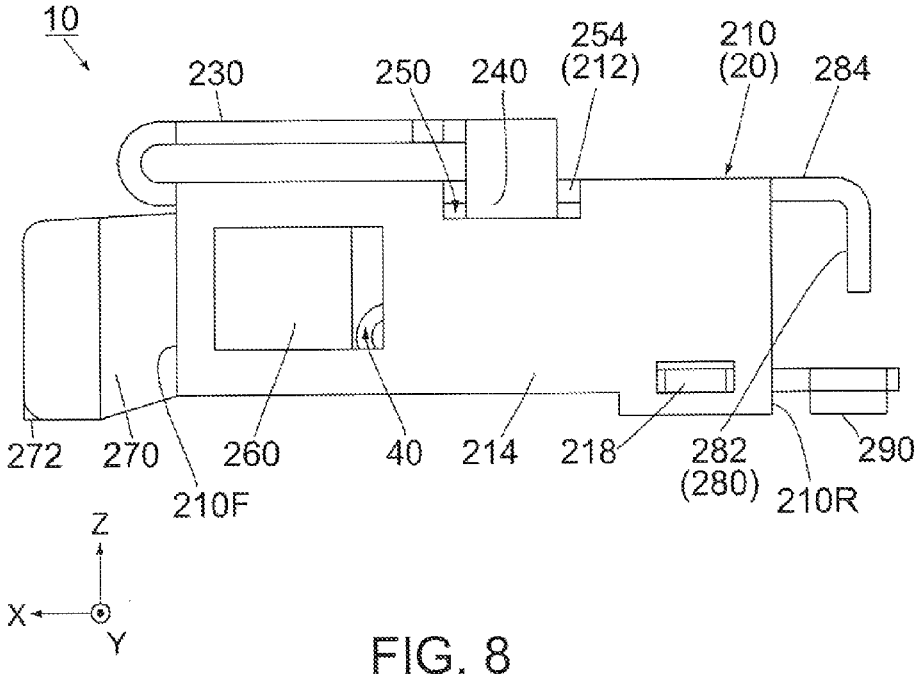
FIG. 8 is a side view showing the connector of FIG. 3.

As shown in FIGS. 3, 4 and 7, each of the operation portions 240 is provided on the beam portion 230. The operation portions 240 are positioned at positions corresponding to the regulation holes 250 in the XY-plane, respectively. In the XY-plane, a size of each of the operation portions 240 is smaller than a size of the corresponding regulation hole 250. Each of the operation portions 240 extends downward from above the main portion 210 in parallel with the XZ-plane and extends into an inside of the insertion space 12 through the corresponding regulation hole 250. When the beam portion 230 is pressed downward to be resiliently deformed, each of the operation portions 240 is moved in the XZ-plane along an operating direction which intersects with the X-direction. In other words, each of the operation portions 240 can be moved in the operating direction by pressing the beam portion 230.

In the present embodiment, the operating direction of the operation portion 240, namely, a direction in which the beam portion 230 is pressed, is downward in the Z-direction, or in the negative Z-direction. Thus the operation direction is toward the upper surface 82 (see FIG. 1) of the circuit board 80 (see FIG. 1). Accordingly, a user can easily apply a force to the beam portion 230. In other words, a user can easily operate the operation portions 240. In addition, since it is not necessary for the upper surface 82 of the circuit board 80 to be provided with spaces which are needed for operations of the operation portions 240, respectively, the connector 10 enables effective use of the upper surface 82. In other words, the connector 10 has a greater flexibility in mounting it to the circuit board 80.

However, the connector 10 may be configured so that the operating direction is slightly oblique to the negative Z-direction. Also in this case, the thus-configured connector 10 has an effect similar to that of the present embodiment. In addition, it is also possible that the operating direction is, for example, the Y-direction. However, form a view point of increasing a flexibility in mounting the connector 10 to the circuit board 80 (see FIG. 1), the operating direction is preferred to be the negative Z-direction or a direction slightly oblique to the negative Z-direction.

Figure 9:
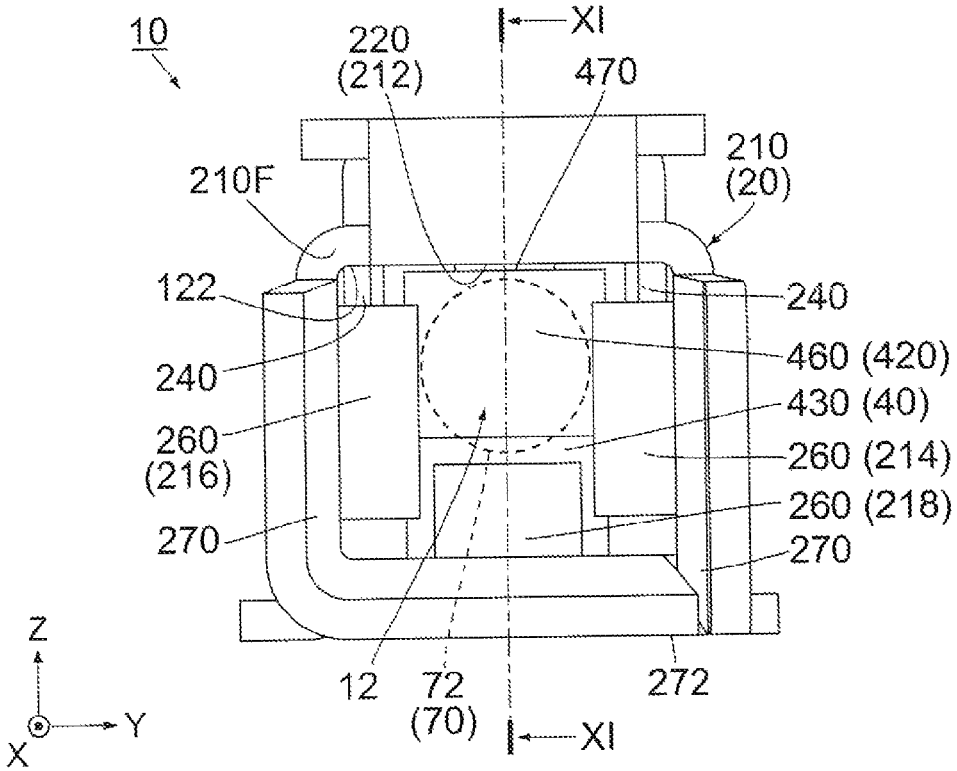
FIG. 9 is a front view showing the connector of FIG. 3.

As shown in FIG. 9, front sides of the operation portions 240 are protected by the guide portions 260 which are provided on the side portions 214, 216, respectively. Accordingly, each of the operation portions 240 does not obstruct the insertion of the conductive core 72 into the insertion space 12. In addition, the conductive core 72 inserted into the insertion space 12 does not obstruct the operation of each of the operation portions 240.

Referring to FIGS. 3 and 7, a rear end of the beam portion 230 is a free end of the beam portion 230 which is supported in the cantilevered manner. Accordingly, the rear end of the beam portion 230 is easily movable in the Y-direction when the beam portion 230 is pressed. When the rear end of the beam portion 230 is moved in the Y-direction, each of the operation portions 240 is also moved in the Y-direction. However, outward movements of the operation portions 240 in the Y-direction are regulated by the side portions 214, 216, respectively, and an inward movement of each of the operation portions 240 in the Y-direction is regulated by an inner wall of the corresponding regulation hole 250 which is positioned inward in the Y-direction. In other words, the shell 20 has two regulation portions 252 and two regulation portions 254. Specifically, the two regulation portions 252 are parts of the side portions 214, 216, respectively, and the two regulation portions 254 are inner walls of the regulation holes 250, respectively, each of which is positioned inward in the Y-direction. Each of the regulation portions 252 and each of the regulation portions 254 regulate a movement of the corresponding operation portion 240 in a predetermined direction which is perpendicular to both the X-direction and the operating direction. In the present embodiment, the predetermined direction is the Y-direction.

In the present embodiment, the shell 20 has parts which are position at opposite sides, respectively, of each of the regulating holes 250 in the Y-direction, or in the predetermined direction, and the parts function as the regulation portions 252, 254, respectively. The regulation holes 250 of the present embodiment are formed on bent portions, respectively, at which the first blank (not shown) is bent for forming the main portion 210. Accordingly, each of the regulation portions 252 is the part of the corresponding side portion 214, 216. However, the present invention is not limited thereto. For example, the regulation hole 250 which is positioned in the vicinity of a positive Y-side of the upper portion 212 may be positioned inwardly away from the side portion 214 in the Y-direction. In this case, the regulation portion 252 is an inner wall of the regulation hole 250 which is positioned outward in the Y-direction. In a case where the operation portion 240 is hardly moved in the Y-direction, the shell 20 may have no regulation portion.

As shown in FIGS. 3, 7, 12 and 13, each of the swing suppressing portions 270 and the swing suppressing portion 272 extends forward from the front end 210F of the main portion 210 and is positioned forward of the entrance opening 122 of the insertion space 12. In detail, the two swing suppressing portions 270 extend forward from the side portions 214, 216, respectively, while a distance therebetween in the Y-direction is gradually increased. The swing suppressing portion 272 extends forward from the bottom portion 218 while gently sloping downward. A dimension of a distance between rear ends of the swing suppressing portions 270 is larger than a dimension of a diameter of the cover 74 of the cable 70. Accordingly, each of the swing suppressing portions 270 does not obstruct the insertion of the conductive core 72 into the insertion space 12.

Referring to FIGS. 2, 3 and 14, in the Y-direction, the two swing suppressing portions 270 hold the cover 74 of the cable 70 under the connection state. Accordingly, the cable 70 is prevented from being swung in the Y-direction. Similarly, the swing suppressing portion 272 suppresses a downward swing movement of the cable 70 under the connection state. In other words, under the connection state, a peripheral wall composed of the swing suppressing portions 270 and the swing suppressing portion 272 suppresses both a Y-directional movement and a downward movement of the cable 70.

The connector 10 may comprise a swing suppressing portion, which extends from the upper portion 212, in addition to the swing suppressing portions 270 and the swing suppressing portion 272. The above-described swing suppressing portion can be formed, for example, by using a part of the beam portion 230. Meanwhile, in a case where a swing movement of the cable 70 does not need to be suppressed, the connector 10 may not comprise the swing suppressing portions 270 and the swing suppressing portion 272.

As shown in FIGS. 5, 7, 8 and 10, the stopper 280 is positioned rearward of the rear end 210R of the main portion 210. The stopper 280 has an abutment portion 282 and two coupling portions 284. The abutment portion 282 extend in the YZ-plane and is positioned rearward of and away from the exit opening 124 of the insertion space 12. The abutment portion 282 overlaps with the exit opening 124 when seen along the X-direction. Each of the coupling portions 284 extends along the X-direction and couples the abutment portion 282 with the upper portion 212 of the main portion 210. The stopper 280 is formed with a check hole 288. The check hole 288 is positioned between the two coupling portions 284 in the Y-direction and pierces the stopper 280 in the Z-direction.

As shown in FIG. 5, the connecting portion 290 is positioned rearward of the rear end 210R of the main portion 210. Referring to FIG. 1, when the connector 10 is used, lower surfaces of the connecting portion 290 are fixed by soldering or the like to the pads 84, respectively, of the circuit board 80 to be connected therewith. In addition, when the connector 10 is used, opposite sides of a lower surface of the swing suppressing portion 272 in the Y-direction are also fixed by soldering or the like to the pads 84, respectively, of the circuit board 80 to be connected therewith. In other words, the swing suppressing portion 272 also functions the connecting portion 272.

Figure 11:
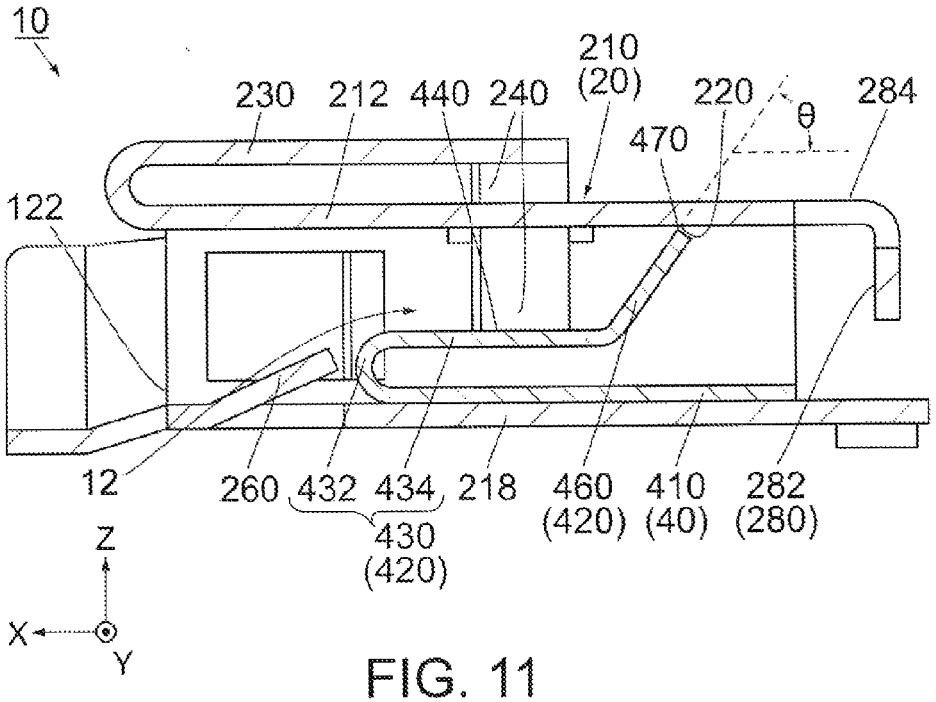
FIG. 11 is a cross-sectional view showing the connector of FIG. 9, taken along line XI-XI.

Referring to FIGS. 11 and 12, the spring member 40 is formed by bending the second blank (not shown) and has a clip-like shape as a whole. The spring member 40 has a plate-like attached portion 410 and a curved plate-like supported portion 420.

The attached portion 410 is fixed on an upper surface of the bottom portion 218 of the shell 20. In particular, the attached portion 410 according to the present embodiment is fixed to the bottom portion 218 by laser welding. However, the present invention is not limited thereto. For example, the attached portion 410 may be fixed to the bottom portion 218 by burring over a part of the bottom portion 218 on the attached portion 410. In addition, the attached portion 410 may not be fixed to the bottom portion 218, provided that the attached portion 410 can be prevented from being offset from the bottom portion 218. In other words, it is sufficient that the attached portion 410 is attached to the shell 20.

The supported portion 420 is supported by the attached portion 410 in a cantilevered manner. The supported portion 420 extends, as a whole, rearward from a front end, or a positive X-side end, of the attached portion 410. The supported portion 420 has a spring portion 430 and a slope portion 460.

The spring portion 430 has a bending portion 432 and a movable portion 434. The bending portion 432 roughly has a half-circular cross-section in the XZ-plane. The movable portion 434 extends rearward from a rear end of the bending portion 432 in parallel with the bottom portion 218 of the shell 20. The slope portion 460 has a rear edge 470, or a press portion 470, in the X-direction. Specifically, the slope portion 460 extends rearward from a rear end of the spring portion 430 so as to have the rear edge 470 while sloping upward.

Referring to FIGS. 12 and 14, the spring portion 430 is resiliently deformable in the XZ-plane. In other words, the spring portion 430 is supported by the attached portion 410 so as to be resiliently deformable. Since the spring portion 430 is made of a hard metal, each of the movable portion 434 and the slope portion 460 is hardly deformed when the bending portion 432 is resiliently deformed. In detail, when the movable portion 434 receives a downward force, mainly the bending portion 432 is resiliently deformed. Meanwhile, each of the movable portion 434 and the slope portion 460 is substantially undeformed and is rotated around the bending portion 432 while an angle which the movable portion 434 and the slope portion 460 make with each other is maintained.

Referring to FIGS. 11, 13 and 14, a slope angle, or an intersecting angle, which the slope portion 460 makes with respect to the XY-plane is varied depending on a degree of the resilient deformation of the spring portion 430, in particular the bending portion 432. According to the present embodiment, under an uninserted state where the conductive core 72 is not inserted into the connector 10, the spring portion 430 is not resiliently deformed and the spring member 40 is in an initial state. Specifically, when the conductive core 72 is not inserted into the connector 10, the slope portion 460 extends in an inclined plane which intersects with the X-direction at an angle equal to or greater than 45° and less than 90°. In detail, the slope portion 460 in the initial state, or in the uninserted state, extends in the inclined plane which intersects with the XY-plane at an angle θ. In the present embodiment, the inclined plane is a plane parallel to the V-direction, and a value of the angle θ is equal to or greater than 45° and less than 90°. However, the inclined plane may intersect not only with the X-direction but also with the Y-direction. Also in this case where the inclined plane intersects with the Y-direction, the slope portion 460 in the uninserted state extends in the inclined plane which intersects with the X-direction at an angle equal to or greater than 45° and less than 90°.

Figure 10:
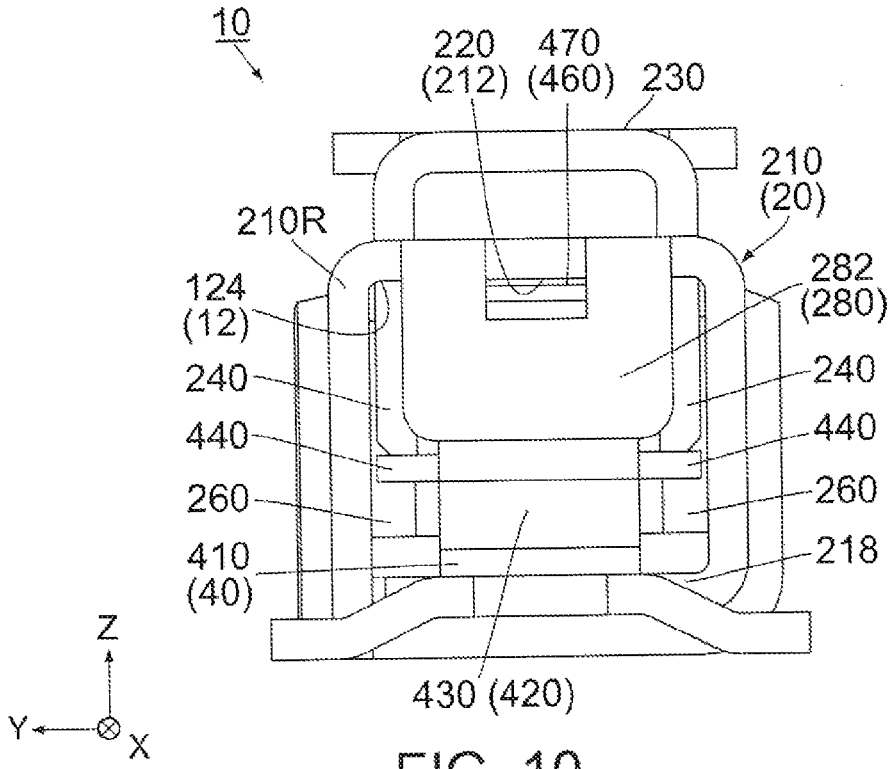
FIG. 10 is a rear view showing the connector of FIG. 3.

As shown in FIGS. 7, 10 and 12, the spring member 40 has two protrusions 440, or two operated portions 440. Under the uninserted state, the protrusions 440 protrude outward in the Y-direction from opposite sides, respectively, of the spring portion 430 in the Y-direction, and each of the protrusions 440 extends in the XY-plane. In other words, each of the protrusions 440 protrudes from the spring portion 430 in a direction which is parallel to the inclined plane while being perpendicular to the X-direction. In the present embodiment, the direction is the Y-direction. In the XY-plane, the protrusions 440 in the initial state are positioned at positions which correspond to the operation portions 240 of the shell 20, respectively. A size of each of the protrusions 440 in the XY-plane is larger than a size of each of the operation portions 240 in the XY-plane.

Referring to FIGS. 12 to 14, when each of the operation portions 240 is moved in the operating direction, or in the negative Z-direction, by the beam portion 230 being pressed in the negative Z-direction, each of the operation portions 240 abuts against the corresponding protrusion 440 to apply a pressing force to the corresponding protrusion 440. The pressing force causes that the spring portion 430 is resiliently deformed so that the slope portion 460 is moved substantially downward. Meanwhile, each of the protrusions 440 is also moved substantially downward. In other words, each of the operation portions 240 moves the corresponding protrusion 440 downward when moved in the operating direction.

As understood from the above explanation, each of the protrusions 440 according to the present embodiment functions as the operated portion 440 which is operable by the corresponding operation portion 240. Since each of the operated portions 440 protrudes outward in the Y-direction from the spring portion 430, the spring member 40 can be provided with the operated portions 440 without the spring member 40 as a whole having an increased width, or an increased size in the Y-direction. Accordingly, the connector 10 can be prevented from being increased in width. However, if the spring member 40 may have an increased width, a part of the spring portion 430 may function as the operated portion 440.

Referring to FIGS. 7 and 14, according to the present embodiment, the two operation portions 240 are positioned at opposite sides, respectively, of the beam portion 230 in the Y-direction, and the two operated portions 440 are positioned at opposite outsides, respectively, of the spring portion 430 in the Y-direction. Each of the operation portions 240 operates the corresponding operated portion 440. Accordingly, the slope portion 400 can be securely moved downward. However, it is possible for the single operation portion 240 to operate the single operated portion 440.

The connector 10 having the aforementioned structure enables the conductive core 72 to be inserted thereinto with zero insertion force (ZIF). Hereafter, explanation is made mainly about an operation by which the conductive core 72 is inserted into the connector 10 with ZIF to be connected therewith.

Referring to FIG. 9, under the uninserted state of the conductive core 72, a dimension of a distance between the rear edge 470 of the slope portion 460 and the contact portion 220 in the Z-direction is smaller than a dimension of a diameter of the conductive core 72.

Referring to FIGS. 9 and 11 to 13, when the conductive core 72 is inserted from the entrance opening 122 into the insertion space 12, the conductive core 72 is guided by the three guide portions 260 to approach the contact portion 220 as described above.

Referring to FIGS. 12 to 14, when the beam portion 230 is pressed downward to move each of the operation portions 240 in the operating direction simultaneously upon the insertion of the conductive core 72, the spring portion 430 of the spring member 40 is resiliently deformed so that the slope portion 460 is moved substantially downward. According to the present embodiment, the beam portion 230 which has a flexible characteristic is resiliently deformable by a slight force while a large force is needed for resiliently deforming the spring portion 430 which has a rigid characteristic. Thus, an operator can easily operate the operation portions 240 and can easily recognize a movement of each of the operated portions 440.

Referring to FIG. 14, if the beam portion 230 is continuously pressed downward, a lower end of the slope portion 460 abuts against the attached portion 410 so that the movement of each of the operated portions 440 is stopped. The aforementioned abutment enables an operator to recognize that the movement of each of the operated portions 440 is stopped. Meanwhile, a dimension of a distance between the rear edge 470 of the slope portion 460 and the contact portion 220 in the Z-direction is larger than the dimension of the diameter of the conductive core 72. Accordingly, the conductive core 72 can be inserted into the connector 10 with ZIF so as to pass between the rear edge 470 and the contact portion 220.

Referring to FIG. 13, in a case where the connector 10 is not provided with the operation portions 240 or the operated portions 440, when the conductive care 72 is inserted into the insertion space 12, an end, or the negative X-side end, of the conductive core 72 abuts against the slope portion 460 of the spring member 40. If the conductive core 72 is formed of, for example, a plurality of conductive thin wires, the conductive core 72 which abuts against the slope portion 460 of a rigid characteristic is bent so that the conductive core 72 cannot be connected with the connector 10. In contrast, according to the present embodiment, when each of the operation portions 240 moves the corresponding operated portion 440, the rear edge 470 is moved away from the contact portion 220. Accordingly, even if the conductive core 72 has a poor strength, the conductive core 72 can be inserted into the connector 10 with ZIF to be connected therewith.

Referring to FIG. 14, when the conductive core 72 is continuously inserted further into the connector 10, the end of the conductive core 72 abuts against the abutment portion 282 of the stopper 280. The aforementioned abutment enables an operator to recognize that the insertion of the conductive core 72 is accomplished. Meanwhile, when an operator stops pressing the beam portion 230, the slope portion 460 is moved upward by a restoring force of the spring portion 430 so that the rear edge 470 of the slope portion 460 presses the conductive core 72 against the contact portion 220. Accordingly, the connector 10 is connected with the conductive core 72 so that the cable 70 and the circuit board 80 are electrically connected with each other. As can be seen from the above explanation, the rear edge 470 functions as the press portion 470 which presses the conductive core 72 against the contact portion 220. In other words, the spring member 40 has the press portion 470.

According to the present embodiment, under the connection state, the contact portion 220 of the shell 20 having high conductivity is brought into contact with the conductive core 72. The lower surface of the upper portion 212 of the shell 20 has a wide area which extends from the front end 210F to the rear end 210R in the X-direction, and the wide area which functions as the contact portion 220 is brought into contact with the conductive core 72. Accordingly, electricity can be easily conducted through the connector 10.

Referring to FIGS. 7 and 14, a part of the conductive core 72 is visible through the check hole 288 of the stopper 280 under the connection state. According to the present embodiment, the conductive core 72 is insertable into the connector 10 with ZIF, and the connection state can be examined by viewing the connector 10 from above. However, the present invention is not limited thereto. In a case where the connection state is sufficiently examined by viewing the connector 10 in the Y-direction, the stopper 280 does not need to be provided with the check hole 288. In addition, the abutment portion 282 may be arranged to be positioned just rearward of the exit opening 124 of the insertion space 12 without the coupling portions 284 of the stopper 280 being provided on the shell 20. Furthermore, the shell 20 may not be provided with the stopper 280.

Referring to FIG. 14, when each of the operated portions 440 is operated by the corresponding operation portion 240 in a manner similar to the operation upon the conductive core 72 being inserted into the connector 10, the connection state can be easily released so that the conductive core 72 under the connection state is removed from the connector 10. Meanwhile, under the connection state, the press portion 470 of the spring member 40 whose material is harder than any of the shell 20 or the conductive core 72 presses the conductive core 72 against the contact portion 220. The thus-configured press portion 470 easily bites into the conductive core 72 when the conductive core 72 is about to be pulled out from the connector 10 under the connection state. Accordingly, the conductive core 72 can be prevented from being pulled out from the connector 10 so that the connection state is securely maintained.

According to the present embodiment, when the conductive core 72 in the connection state is about to be pulled out from the connector 10, the press portion 470 of an angular shape shaves the conductive core 72 while biting into the conductive core 72 to stop the pulling out of the conductive core 72. Accordingly, the connection state is securely maintained. Under the uninserted state of the conductive core 72, the slope portion 460 intersects with the X-direction at a great angle θ (see FIG. 11). Therefore, the slope portion 460 intersects with the X-direction at a great angle also under the connection state. Accordingly, the slope portion 460 easily bites into the conductive core 72. From a point of view of the conductive core 72 being surely held by the connector 10, it is preferable that the angle θ is equal to or greater than 45°, and it is more preferable that the angle θ is equal to or greater than 60°.

The connector 10 according to the present embodiment can be further variously modified in addition to the already explained modifications. For example, the operation portion may not be provided on the beam portion. Specifically, the operation portion may be formed by making an incision in the side portion of the main portion and then bending the incision into the insertion space. The slope portion of the spring portion may be fixed directly on the upper surface of the bottom portion of the main portion to be supported thereby. The contact portion of the shell may not be the lower surface of the upper portion of the main portion. The lower surface of the upper portion may be provided with a protruding portion which functions as the contact portion. In addition, it is also possible that an inner surface of the side portion functions as the contact portion.

The present application is based on a Japanese patent application of JP2015-131328 filed before the Japan Patent Office on Jun. 30, 2015, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector connectable with a conductive core of a cable which is inserted from a front of the connector along a front-rear direction, wherein:

the connector comprises a shell and a spring member;

the shell is made of a metal;

the shell has an operation portion and a contact portion;

the spring member is made of another metal which is harder than the metal of the shell;

the spring member has an operated portion and a press portion;

when the operation portion moves the operated portion, the press portion is moved away from the contact portion; and the press portion presses the conductive core against the contact portion under a connection state where the conductive core is connected with the connector.

2. The connector as recited in claim 1, wherein the shell is higher in conductivity than the spring member.

3. The connector as recited in claim 1, wherein:

the spring member has a slope portion;

the slope portion has a rear edge in the front-rear direction;

when the conductive core is not inserted into the connector, the slope portion extends in an inclined plane which intersects with the front-rear direction at an angle equal to or greater than 45° and less than 90°; and the rear edge of the slope portion functions as the press portion.

4. The connector as recited in claim 3, wherein:

the spring member has an attached portion and a spring portion;

the attached portion is attached to the shell;

the spring portion is supported by the attached portion so as to be resiliently deformable;

the spring portion has a rear end in the front-rear direction; and the slope portion extends from the rear end of the spring portion.

5. The connector as recited in claim 4, wherein:

the spring member has a protrusion which functions as the operated portion; and the protrusion protrudes from the spring portion in a direction, the direction being parallel to the inclined plane while being perpendicular to the front-rear direction.

6. The connector as recited in claim 1, wherein:

the operation portion is movable in an operating direction which intersects with the front-rear direction; and the operation portion moves the operated portion when moved in the operating direction.

7. The connector as recited in claim 6, wherein:

the connector is fixed on an object in an up-down direction perpendicular to the front-rear direction when used; and the operating direction is downward in the up-down direction.

8. The connector as recited in claim 6, wherein:

the connector is formed with an insertion space into which the conductive core is inserted;

the shell has a main portion;

the main portion surrounds the insertion space in a perpendicular plane which is perpendicular to the front-rear direction; and the insertion space has an entrance opening which opens forward.

9. The connector as recited in claim 8, wherein:

the shell has a beam portion;

the beam portion is supported by the main portion in a cantilevered manner so as to be resiliently deformable; and the operation portion is provided on the beam portion.

10. The connector as recited in claim 8, wherein:

the main portion has a guide portion; and the guide portion narrows the insertion space in the perpendicular plane while extending rearward.

11. The connector as recited in claim 8, wherein:

the shell has a swing suppressing portion; and the swing suppressing portion extends forward from the main portion while being positioned forward of the entrance opening.

12. The connector as recited in claim 8, wherein:

the shell has a regulation portion; and the regulation portion regulates a movement of the operation portion in a predetermined direction which is perpendicular to both the front-rear direction and the operating direction.

13. The connector as recited in claim 12, wherein:

the shell has two of the regulation portions;

the main portion is formed with a regulation hole;

the operation portion extends into an inside of the insertion space through the regulation hole;

the shell has parts which are positioned at opposite sides, respectively, of the regulation hole in the predetermined direction; and the parts function as the regulation portions, respectively.

14. The connector as recited in claim 8, wherein:

the insertion space has an exit opening which opens rearward;

the shell has a stopper;

the stopper has an abutment portion and a coupling portion;

the abutment portion is positioned rearward of and away from the exit opening while at least overlapping with the exit opening when seen along the front-rear direction; and the coupling portion couples the abutment portion with the main portion.

15. The connector as recited in claim 14, wherein:

the stopper is formed with a check hole; and a part of the conductive core is visible through the check hole under the connection state.

* * * * *